US005460844A

United States Patent [19]

Gaylor

[11] Patent Number: 5,460,844

[45] Date of Patent: Oct. 24, 1995

[54] METHOD AND APPARATUS FOR MANUFACTURING INFUSION PACKAGES

[75] Inventor: Ian M. D. Gaylor, Nr. Grantham, United Kingdom

[73] Assignee: A. G. (Patents) Limited, London, England

[21] Appl. No.: 211,583

[22] PCT Filed: Oct. 9, 1992

[86] PCT No.: PCT/GB92/01843

§ 371 Date: Jun. 7, 1994

§ 102(e) Date: Jun. 7, 1994

[87] PCT Pub. No.: WO93/07061

PCT Pub. Date: Apr. 15, 1993

[30] Foreign Application Priority Data

Oct. 9, 1991 [GB] United Kingdom ..... 9121420

[51] Int. Cl.[6] ..... B65D 29/04

[52] U.S. Cl. ..... 426/394; 426/77; 426/80; 426/82; 426/433; 426/435; 53/134.2; 53/449; 53/451; 53/546; 53/554; 53/548; 206/0.5

[58] Field of Search ..... 426/77, 80, 81, 426/82, 83, 84, 431, 432, 433, 435, 394; 53/413, 449, 451, 134.2, 546, 554, 548; 206/0.5

[56] References Cited

U.S. PATENT DOCUMENTS

| | | | |
|---|---|---|---|
| Re. 25,839 | 8/1965 | Stroop | 53/546 |
| 2,083,617 | 6/1937 | Salfisberg | 53/554 |
| 2,350,930 | 6/1944 | Salfisberg | 53/413 |
| 2,608,405 | 8/1952 | Salfisberg et al. | 53/546 X |
| 2,673,430 | 3/1954 | Fleischer et al. | 53/546 |
| 2,730,852 | 1/1956 | Clark | 53/546 |
| 3,077,063 | 2/1963 | Stroop | 53/546 |
| 3,210,908 | 10/1965 | Samberg | 53/546 |
| 3,316,686 | 5/1967 | Welin-Berger | 53/449 X |
| 3,383,269 | 5/1968 | Kopp | 53/546 X |
| 3,596,428 | 8/1971 | Young et al. | 53/28 |
| 3,641,737 | 2/1972 | Tamagni | 53/554 |
| 3,846,569 | 11/1974 | Kaplan | 426/394 |
| 4,646,510 | 3/1987 | McIntyre | 53/449 |
| 4,726,956 | 2/1988 | Christie | 426/80 |
| 4,853,071 | 8/1989 | Romagnoli | 53/134.2 X |
| 4,856,257 | 8/1989 | Romagnoli | 53/134.2 |
| 4,880,651 | 11/1989 | Christie | 426/394 |
| 5,233,813 | 8/1993 | Kenney et al. | 53/450 |

FOREIGN PATENT DOCUMENTS

| | | |
|---|---|---|
| 0095542 | 12/1983 | European Pat. Off. . |
| 674886 | 7/1952 | United Kingdom . |
| 1245359 | 9/1971 | United Kingdom . |
| 2201935 | 9/1988 | United Kingdom . |

*Primary Examiner*—Donald E. Czaja
*Assistant Examiner*—Milton I. Cano
*Attorney, Agent, or Firm*—Charles E. Baxley

[57] ABSTRACT

A travelling two-ply web of infusion packages (11) is cut transversely by rotary cutting device (50) to form individual packages (1) which are attached to a styrene cover web (70). The packages 91) and web (70) are fed at the same speed rotary attachment device (100) comprising heated welding tips (102) cooperating with an anvil roller (90). The web (70) is fed to the attachment device at constant speed, but the packages (1) are accelerated up to the speed of the web (70) by accelerating rollers (62, 63) which grip the sealed edges of the packages. This introduces the necessary gap between successive packages. A hinge line (5) is produced in the web (70) by hinging device which facilitates folding of the cover and the package when the web carrying attached packages is cut into individual lengths.

28 Claims, 8 Drawing Sheets

METHOD AND APPARATUS FOR MANUFACTURING INFUSION PACKAGES

The present invention relates generally to infusion packages such as tea and coffee bags and similar bags containing herbal or other infusions. Specifically the invention relates to a method and apparatus for manufacturing infusion packages having a cover attached thereto, comprising joined leaves extending over opposed surfaces of the package.

A covered infusion package is disclosed in GB-A-2167380. That package has a cover formed by two leaves joined at a fold line, the package being secured to one of the leaves e.g. by heat sealing below the fold line. The leaves extend beyond the edges of the package around its complete periphery. In use the package is suspended over the edge of a cup by folding back the leaves which are then placed outside the cup. Once the infusion is complete, the package is removed from the cup by the leaves which are then folded over the package to allow the residue to be squeezed from the package, if desired, and also to allow a user conveniently to dispose of the package.

WO-87/06913 and WO-90/00497 disclose machines for manufacturing such packages. In the machines disclosed, cover material is moved in an intermittent manner to a welding head at which an infusion package is heat sealed to a cover. The present invention seeks to provide an improved method and apparatus for the manufacture of such packages, which will enable increased production rates.

From a first aspect, the invention provides a method of manufacturing infusion packages provided with a cover comprising a pair of leaves joined about a fold line and extending over opposed sides of the package, comprising forming infusion containing pockets in a continuously travelling two-ply porous web, passing said web through a rotary cutting device which forms a transverse cut through sealed regions of the web between the pockets to form a plurality of individual infusion packages, feeding continuously a web of cover material to a rotary attachment means which is synchronised with the cutting device and arranged to attach the packages to the web at a region adjacent a transverse edge of each package, feeding said packages from the rotary cutting device to said attachment means such that at the time they are attached to said web of cover material the packages and the web are travelling at substantially the same speed, each package being accelerated either before or immediately after it is attached to the web so that a gap is formed between it and the next package to be attached to the web, and cutting said web of cover material to produce individual lengths of cover material, each having an infusion package arranged towards one end thereof whereby the other end of the cover material may be folded over to enclose the package therebetween.

From a second aspect the invention provides apparatus for manufacturing infusion packages provided with a cover comprising a pair of leaves joined about a fold line, comprising a rotary cutting device for forming a transverse cut through sealed regions between infusion containing pockets in a travelling two-ply porous web to form a plurality of individual packages, rotary attachment means synchronised with said cutting device for attaching said packages to a web of cover material at a region adjacent a transverse edge of each package, means for continuously supplying said web of cover material to said attachment means, means for supplying said packages to said attachment means, such that at the time they are attached to said attachment means the packages and the web are travelling at substantially the same speed, means for accelerating each infusion package either before or immediately after it is attached to the web so that a gap is formed between it and the next package to be attached to the web, and means for cutting said web of cover material to produce individual lengths of cover material each having an infusion package arranged towards one end thereof whereby the other end of the cover material may be folded over to enclose the package therebetween.

Thus in accordance with the invention, a cover web is fed continuously to a rotary attachment means at which infusion packages are attached to it. The packages are fed to the attachment means continuously such that at the attachment means, they travel at the same speed as the cover web. This allows a satisfactory join to be obtained. Furthermore, the packages are accelerated so as to introduce the necessary gap between them. It will be appreciated that this is necessary since a length of cover material of approximately twice the length of an infusion package will be required per package. Thus the average rate of supply of the web material will be greater, for example, approximately twice that of the packages. The invention facilitates a higher production rate of covered packages.

Preferably the rotary attachment means comprises means for heat sealing or welding the packages to the web, which may be of an impervious insulating material such as styrene, for example. Thus in a preferred embodiment the attachment means may comprise a heated rotary member having one or more heat sealing or welding heads which, for example, co-operate under pressure with an anvil roller, the package and web of cover material passing together between the head and the anvil roller to be joined together.

In a particularly preferred embodiment, however, the cover web and the infusion packages are conducted between a heated rotary member and a co-operating, moving belt extending around a portion of the circumferential path of the attachment head or heads. The belt driven is driven by suitable drive means so that its speed is matched to the peripheral speed of the head so that in the region of co-operation of the head with the belt, there is no relative movement between the head and the belt.

It has been found that such an arrangement gives an improved bond between the package and the cover web, since a longer period of welding or heat sealing can be achieved, compared to an anvil roller arrangement where essentially only a point contact occurs. Since a longer sealing period can be achieved, the temperature of the welding head may be lowered and the contact pressure between the head and the belt lowered. This has been found to reduce the danger of heat damage to the cover web, and also to improve the adhesion of the package to the web. It would appear that the longer contact time (in practice about 150 ms) allows the cover web material more efficiently to melt into the porous web material of the package and solidify there.

Preferably the belt, which may be of a suitable heat-resistant material, such as a woven glass fabric, for example coated with polytetrafluoroethylene (p.t.f.e.), extends over an arc of at least 45° and most preferably at least 90° of the circumferential path of the welding head(s). To provide a reaction surface, the belt is preferably provided with an arcuate backing member which is preferably resiliently mounted so as to urge the belt towards the welding head(s). Preferably the block is of high chrome steel with a high polish finish on its surface contacting the belt.

Whilst the infusion packages will be held against the cover web by the co-operation of the welding head and the belt, additional holding means may be provided on the attachment means to prevent the packages from lifting from the cover web in other areas. To this end, the rotary attachment means may be provided with a pressing member, for example a wheel, which engages with an edge seam of the infusion package to press it against the cover web.

Whilst the above system of attachment has been described in the context of attaching infusion packages to a cover web, it is applicable to attaching any article to a web of material and from a further aspect, therefore, the invention provides a method of attaching an article to a web of moving material wherein the article and the web are introduced into the nip between a heated rotary attachment member and a moving belt extending around a portion of the circumferential path of said rotary attachment member, and biased against said attachment member, the speeds of said belt and said rotary member being matched so that substantially no relative movement occurs between them in said portion. This aspect of the invention also extends to apparatus for performing this method.

Returning to the manufacture of infusion packages in accordance with the invention, the packages may be accelerated to produce the required gap either before or after they have been joined to the web of cover material. As stated above, the average speed of supply of the web of cover material is greater than that of the packages. Thus to match the speeds of the packages and web at the attachment means, either the speed of the web of cover material must be temporarily reduced to that of the packages or the speed of the packages increased to that of the web.

In one embodiment, therefore, the web of cover material is slowed down temporarily at the attachment means to match the speed of the packages, which at that time are preferably still attached to the two-ply web of packages. After the package has been joined to the web and the package cut from the two-ply web of packages, the web of cover material, with the package attached to it, is accelerated to above its normal speed so as to produce a gap between the package first secured to the web and the next to be secured thereto. Thus at the point where the package is attached to the web of cover material, the speed of that web will oscillate cyclically about the nominal speed of the web. This could be achieved in practice by providing take up rollers in the web supply which sequentially move towards and away from one another, to reduce the speed of the web, and together to allow it to accelerate. This system may not, however, be preferred for higher production rates since it may place considerable stresses on the web of cover material and the weld between the web and package and would require rapid movement of the take up rolls.

Thus it is preferred to accelerate the packages to introduce the gap therebetween and to match the higher feed speed of the web of cover material prior to feeding the packages to the attachment means. This arrangement allows for a constant speed of supply of the web of cover material to the attachment means at a speed which will typically be around or slightly higher than twice the feed speed of the infusion pocket web. Acceleration of the package preferably takes place immediately after it has been cut from the two-ply web by the cutting device, which preferably comprises co-rotating cutting rollers which cut the web transversely to its direction of motion.

The packages are preferably accelerated by co-rotating rollers which grip the package, preferably by its longitudinal sealed edges and feed it to the attachment means at the required speed. Both rollers may be driven, or in another arrangement only one roller need be driven, the other roller acting as an idler. Preferably the packages are fed generally vertically through the cutting device and the acceleration means to the attachment means, to obviate the need for separate package conveyors.

The operation of the acceleration means is synchronised with that of the attachment means and the cutting device. Preferably the rollers engage the respective packages before they are cut from the web of pockets, and rotate with a surface speed equal to that of the speed of the packages through the cutting device until the packages are cut from the web. The rotational speed of the rollers is then increased so as both to accelerate the packages to match the speed of the web of cover material and also to gap the packages longitudinally one from the other. Preferably each package is initially accelerated to a speed above that of the web or cover material and then decelerated to match the speeds, as it is found that this results in greater stability at the point of attachment.

The speed of rotation of the acceleration rollers may be directly linked to that of the rotary cutting device whereby after the packages have been cut, the cutting device accelerates in the same manner as the acceleration rollers. During the period of acceleration the cutting device does not grip the packages which pass through the device, preferably under gravity and their own momentum. A number of cutting edges may be provided on the cutting device. In a preferred arrangement, this allows a relatively large diameter cutting roller to be used, which is a more rigid arrangement.

At the attachment means the packages and the web of cover material are moving together at the same speed and are joined together, in the preferred embodiment, by a rotary welding head. Thereafter the package is carried with the web, which is then cut transversely into individual lengths of cover material each having a package attached thereto. The covers may then be folded over the package about a hinge line to complete the process. In one embodiment, the unfolded package is carried along a conveyor with the package occupying the rear part of the cover. A cam lifts the leading edge of the cover into a guide which as the cover passes along the conveyor folds the front half of the cover back over the package. The covered packages may then be loaded into cartons by convenient means.

A hinge line in the cover is preferably formed in the web of cover material before the package is attached to the web. Conveniently this may be done by forming a number of perforations across the web, for example using a rotary perforating blade the operation of which is synchronised with the attachment means and acceleration means whereby the package will be attached to the web of cover material in the correct position relative to the hinge line. Advantageously for some materials, for example foamed styrene, the blade is heated, and it may in a preferred embodiment co-operate with the same anvil roller as does the welding head, or with a separate roller.

In certain circumstances, for example in the coffee bags, it is desirable to seal the bag. This may be achieved in a preferred embodiment by for example, heat sealing the edges of the respective cover leaves together around their complete periphery.

The invention may be applied in a so-called single lane machine, in which a single stream of packages is produced, or in a multi-lane machine in which a number of streams of packages are produced simultaneously. In such a case, the travelling two-ply web of infusion containing pockets will be of several pockets' width and it will be necessary to divide the web both longitudinally in the direction of motion and transversely thereto to produce individual packages.

In a preferred embodiment the web is split longitudinally to provide a number of parallel strips of infusion containing pockets which are then cut transversely and attached to cover web material as described above. Such an arrangement is the subject of our separate application filed on the same date and entitled "Manufacturing Infusion Packages".

Preferably the infusion pocket web is split longitudinally by means which removes a longitudinal strip of web material from the sealed region between the or each adjacent longitudinal row of infusion containing pockets to produce parallel travelling strips of sealed pockets which are spaced part from each other in a direction transverse to the direction of movement.

The width of the strip of material removed from between adjacent pockets is chosen such that after attachment to the cover material, the cover material will overlap the edge of the package by a desired amount. The outer edges of the web of pockets may also be trimmed if necessary to ensure that the correct cover overlap is obtained in the outermost packages of the row.

The strip of web material may be removed from between adjacent infusion containing pockets by any convenient means for example cutting. In one arrangement the strip is "crush" cut by cutting means comprising a rotating cutting wheel having transversely spaced upstanding cutting edges on its outer periphery which co-operate under pressure with the surface of a co-rotating plain anvil wheel. Preferably however, the strip is removed by shear cutting, co-rotating cutters being provided with co-operating shearing cutting edges. This is found to give a cleaner cut.

Preferably means is provided for conducting the strips of waste web away from the cutters. In one embodiment, the strips are removed by vacuum means. A vacuum duct may be placed closely adjacent the cutters, the strips then being sucked into the duct. Conveniently, respective ducts are provided at the respective cutters each to receive a single strip of waste web. Means may be provided, if necessary, positively to guide a waste strip into the removal means to prevent the waste from becoming entangled with the cutters.

After the web of pockets has been cut into separate, transversely spaced strips of pockets, the individual packages cut from each strip are attached to the cover material as described above. Although it would be possible to provide a separate web of cover material for each strip of infusion packages, it is preferred to supply the cover material as a web which extends transversely across a plurality, and preferably all, of the strips. The packages will then be attached to the web of cover material in parallel rows across the web which is then cut both transversely and longitudinally to produce individual covered packages with each cover overlapping the edges of the packages in the transverse direction. Such an arrangement will reduce the amount of material initially to be removed from between the packages since no allowance need be made for spacing of adjacent webs of cover material. This will also lead to a more compact construction of apparatus, and will be more simple to control than an arrangement with multiple webs of cover material. It will also be appreciated that the present invention facilitates the accurate positioning of the packages on the web of cover material.

The invention extends to covered infusion packages fabricated by means of the method and apparatus described above.

Some preferred embodiments of the invention will now be described by way of example only, with reference to the accompanying drawings in which.

Figure 1:
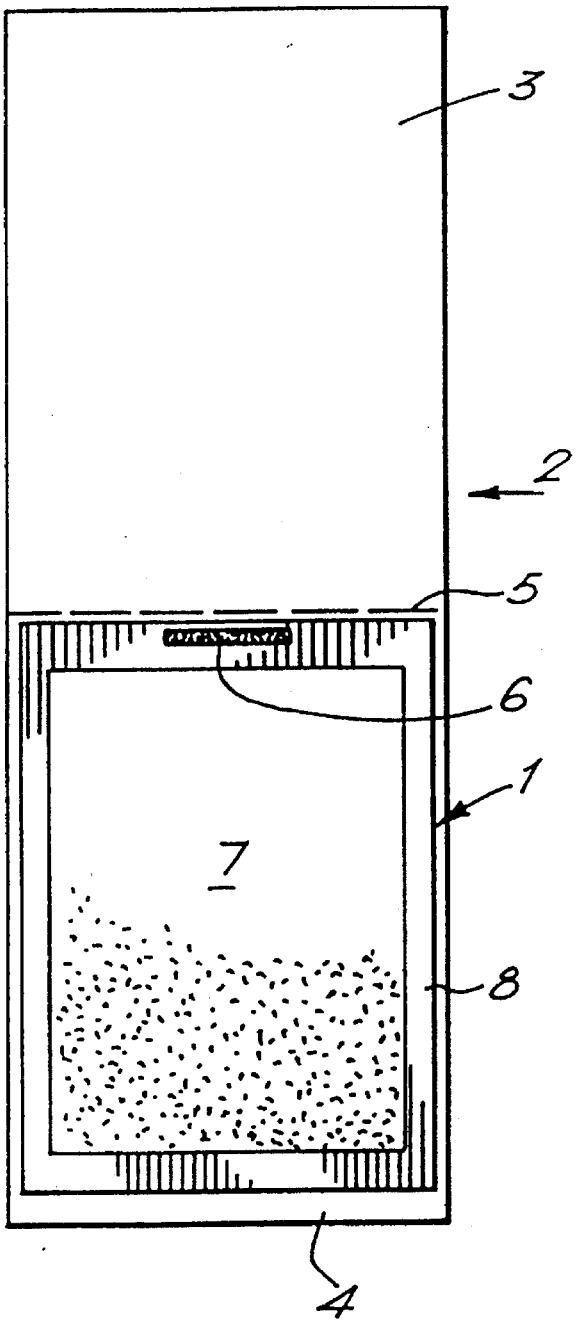
FIG. 1 is a plan view of a covered infusion package, with its cover folded back.
Figure 2:
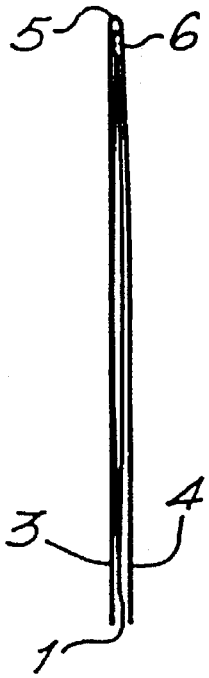
FIG. 2 is a side view of the infusion package of FIG. 1 with its cover folded into position.

FIGS. 1 and 2 show an infusion package 1 provided with a cover 2 having leaves 3,4 joined about a hinge line 5. The infusion package 1 is attached to the cover leaf 4 by a weld 6. The leaves 3,4 overlap the edges of the infusion package 1 around its entire periphery. As is well known in the art, the infusion package 1 comprises two webs of thermoplastics coated tissue which are heat sealed to each other around an infusion containing pocket 7 to define a land 8 around the periphery of the pocket. When it is desired to brew an infusion, the cover leaf 3 is folded back to lie behind cover leaf 4 and the package-1 placed in a cup, the leaves 3,4 hanging over the edge of the cup. Once the infusion has brewed, the cover leaf 3 is folded back over the package 1 as shown in FIG. 1 to squeeze any residue from the package for subsequent disposal of the package 1 in a clean manner.

Figure 3:
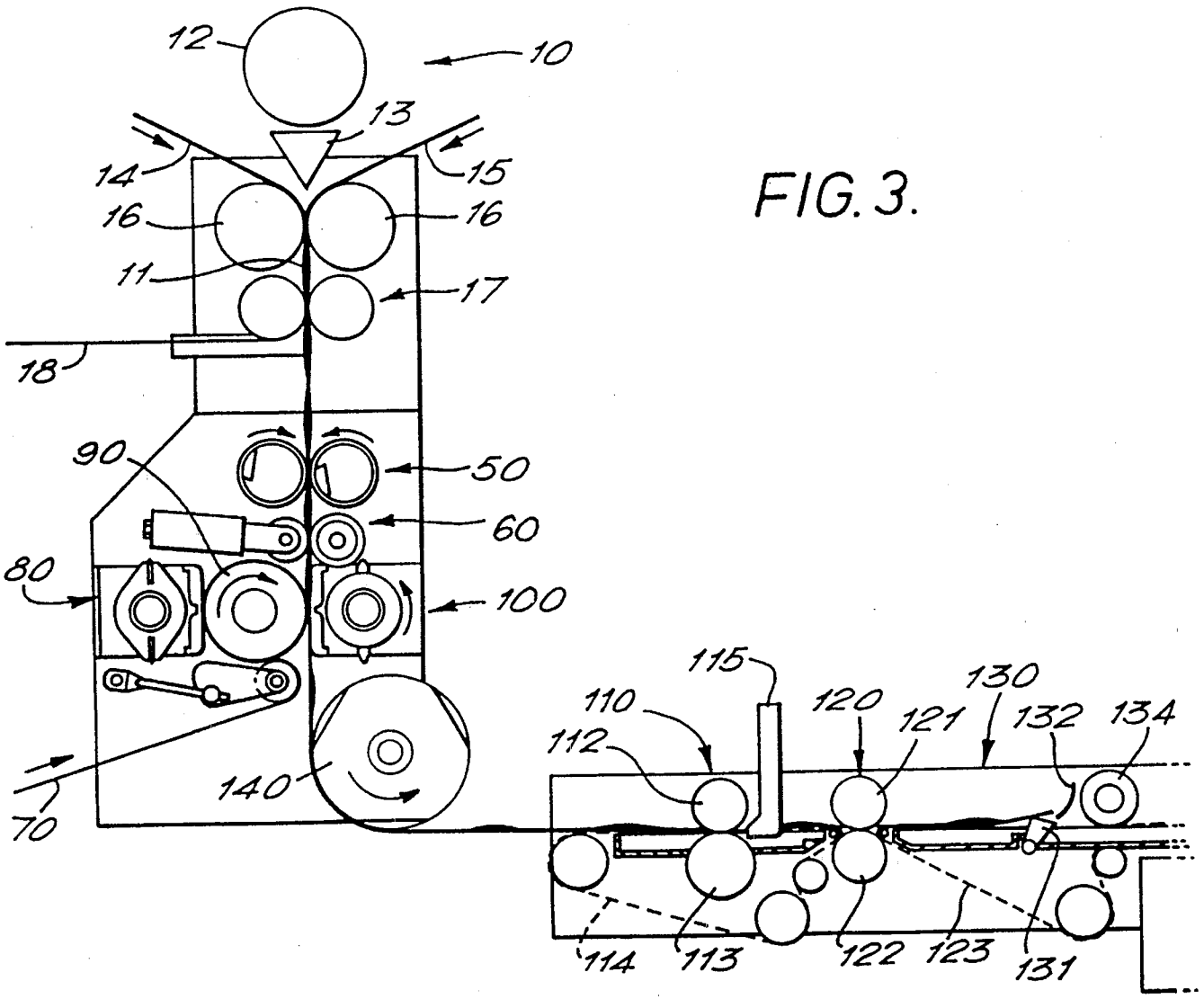
FIG. 3 is a schematic side view of an embodiment of the invention.
Figure 6:
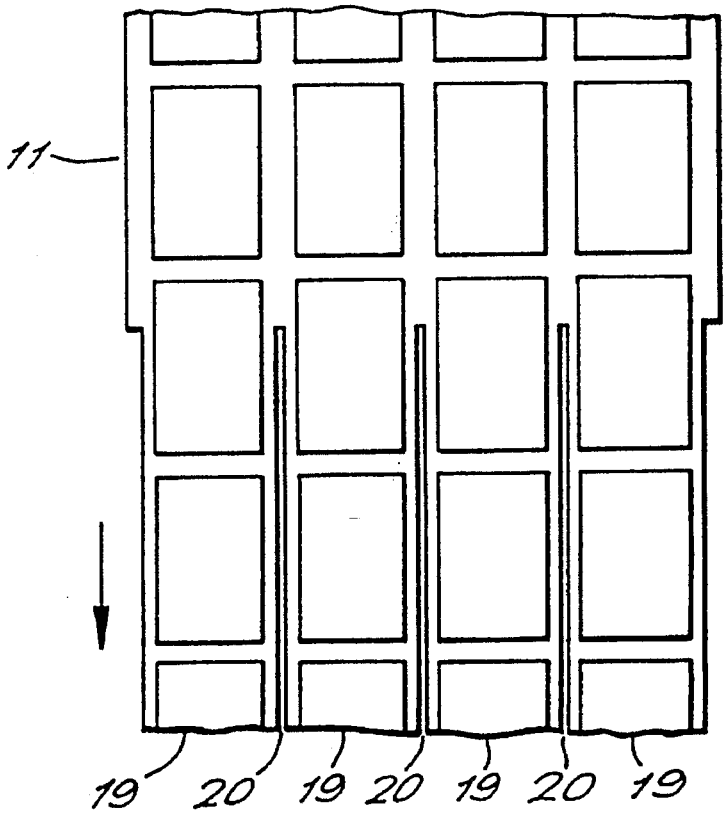
FIG. 6 shows a web of infusion packages at an intermediate step in the method of the invention.
Figure 7:
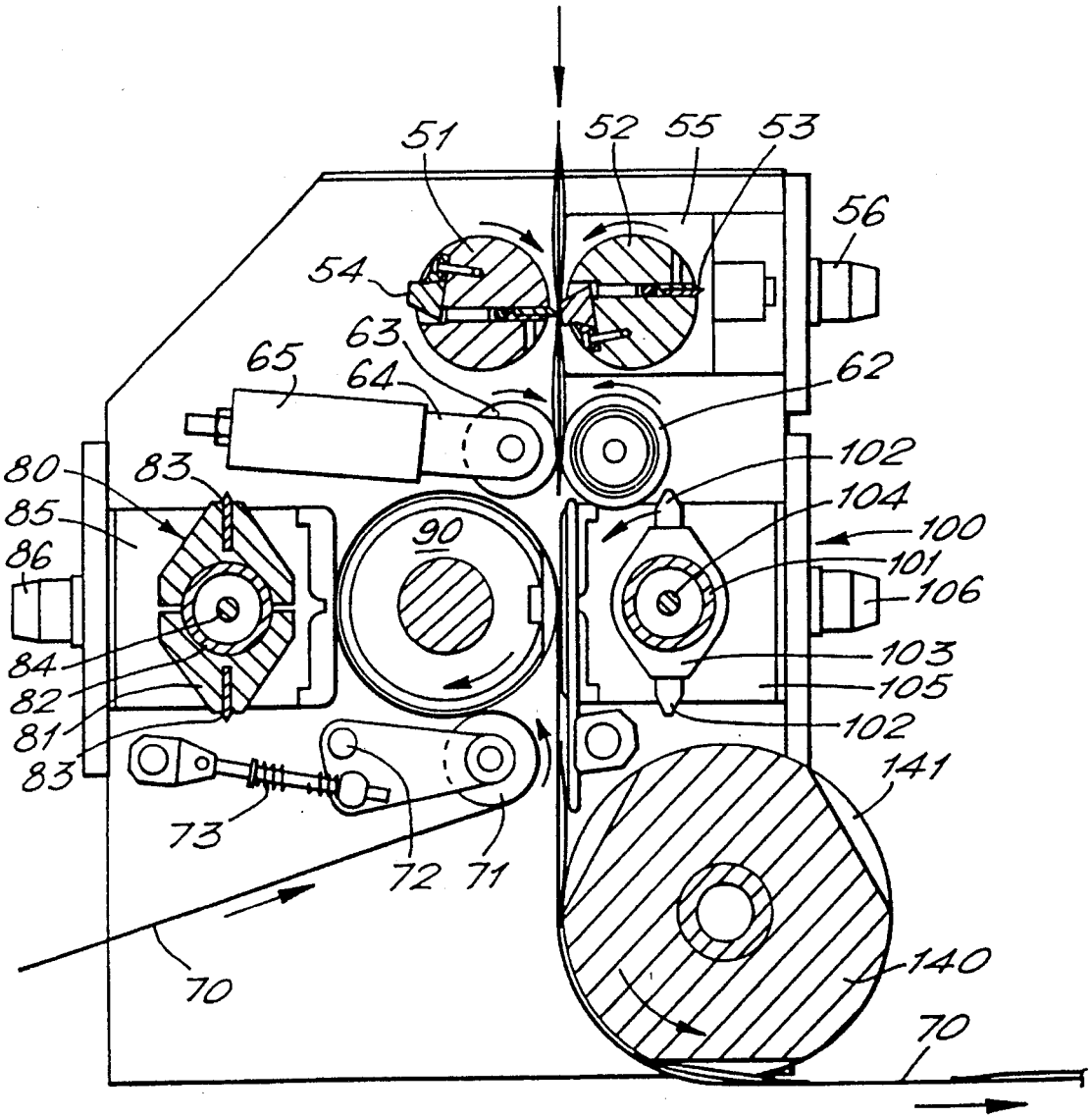
FIG. 7 is a side view of a further part of the apparatus shown in FIG. 3.

Referring now to FIG. 3, a machine for producing infusion packages as shown in FIGS. 1 and 2 comprises means 10 for producing a travelling two-ply web 11 containing successive rows of infusion containing pockets 1 extending transversely to the direction of movement of the web 11 (FIG. 6).

The travelling web 11 is then fed continuously, at constant speed, to means 17 for removing waste strip 18 of material from between adjacent packages to form a plurality of travelling strips 19 of infusion containing pockets 7 with sealed peripheries. The strips 19 then pass to transverse cutting device 50 which cuts the strips 19 into individual packages 1.

At the same time, a single web of cover material 70 is fed at constant speed via hinging means 80 over an anvil roller 90 to welding means 100. It will be apparent that the web 70 will be travelling at approximately twice the speed of the strips 19 of infusion packages since a length of web 70 of approximately twice the length of an infusion package is required to produce a covered package. It is also desirable that as the packages and web move through the welding means 100 they are travelling at the same speed. Accordingly the packages cut from the respective strips 19 are accelerated by means 60 arranged between the transverse cutting device 50 and the welding means 100, which also introduces a gap between successive packages.

The welding means 100 attaches the transversely adjacent packages to the web 70, whereafter the web 70 is split longitudinally by longitudinal cutting means 110 and then transversely by transverse web cutting device 120, to produce a plurality of individual lengths of cover having a package attached to the rear upper surface thereof. The front portion of the cover is then folded over the package 1 at a folding station 130, whereafter the packages may be removed for packaging.

The process and apparatus will now be described in greater detail with reference to FIGS. 3 to 8 of the description.

As stated earlier, means 10 is provided for producing a travelling two-ply web containing successive rows of infusion containing pockets 7 (see FIG. 6). Such means is known in the art and comprises a rotary dosing head 12 (FIG. 3) which doses measured amounts of infusion into a plurality of hoppers 13 arranged across webs 14,15 of thermoplastics coated tissue material. The hopper 13 reciprocates vertically and drops the measured doses of infusion between the webs 14,15, which are continuously fed into the nip between co-rotating heat sealing rollers 16. Raised regions (not shown) on the rollers 16 co-operate to seal the webs 14,15 to form rows of packages 1 comprising infusion containing pockets 7 with sealed peripheries 8.

The two-ply web 11 is then conducted to longitudinal cutting means 17 for removing waste strip 18 of web material from between the adjacent pockets 7 to form respective strips 19 of pockets with gaps 20 between them. The strip removal means 17 is shown in greater detail in FIGS. 4 and 5 and comprises co-rotating cutting means 21 and means 22 for removing the waste strips 18.

The cutting means 21 comprises co-rotating shafts 23,24 journaled at their ends in supports 25 and driven through meshing gears 26. Shaft 23 mounts respective cutting wheels 27–31, which rotate with the shaft 23 and are adjustably arranged at a desired spacing from one another. The inner wheels 28–30 are each provided with two peripheral cutting edges 32,33, while the outermost wheels 27,31 each have a single cutting edge 34. Shaft 24 slidably mounts respective pairs of inner cutting wheels 35 and outer cutting wheels 36 the wheels rotating with the shaft 24. Each cutting wheel 35,36 has a single cutting edge 37 which co-operates with a respective cutting edge 32,33,34 on the cutting wheels 27–31 to define, as the wheels rotate, co-operating shearing cutting edges for removing the strips 18 from between the packages and also at the edges of the web 11. Coil springs 38 press the wheels 35,36 mounted as shaft 24 against the sides of the wheels 27–31 mounted on shaft 23.

Figure 4:
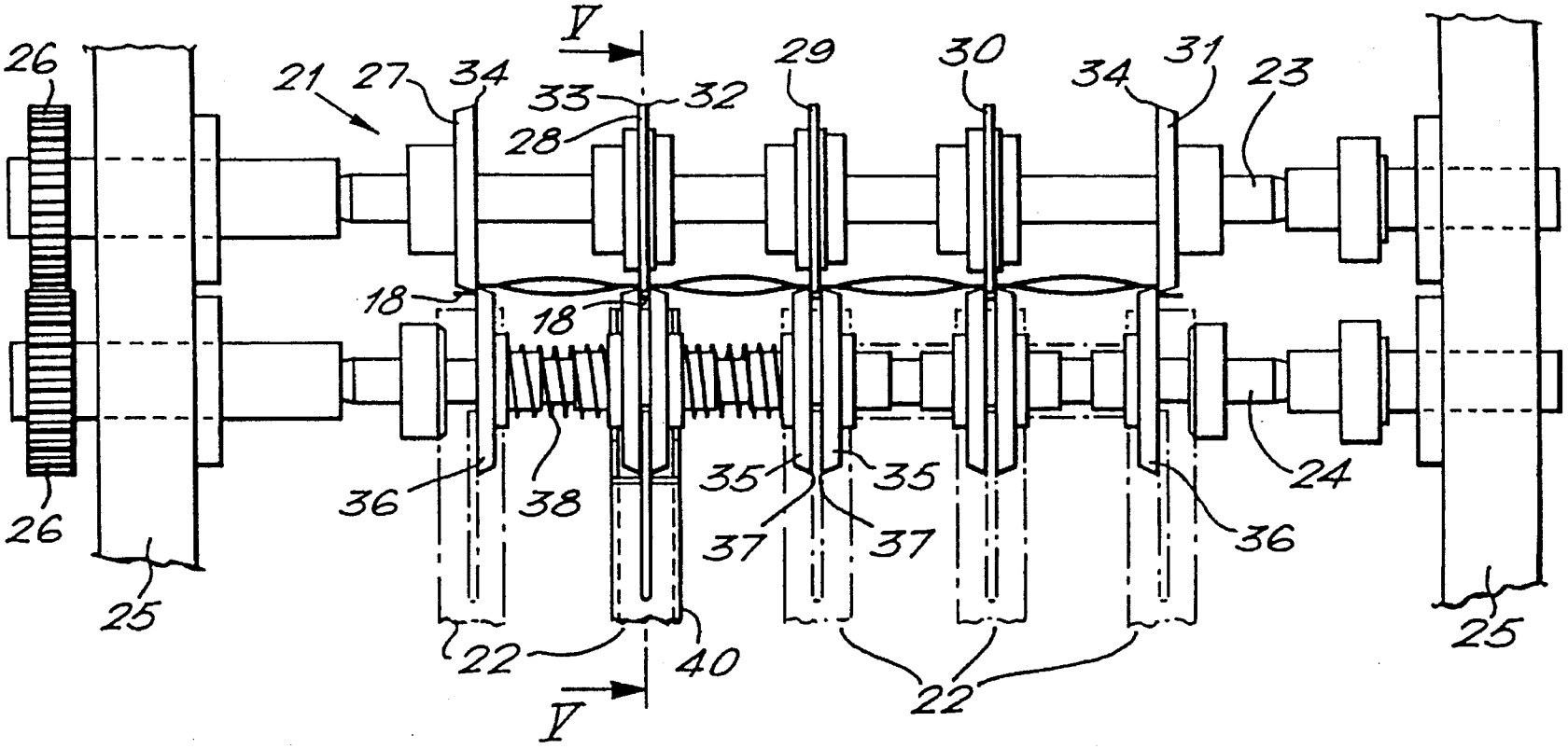
FIG. 4 is a plan view of part of the apparatus of FIG. 3.
Figure 5:
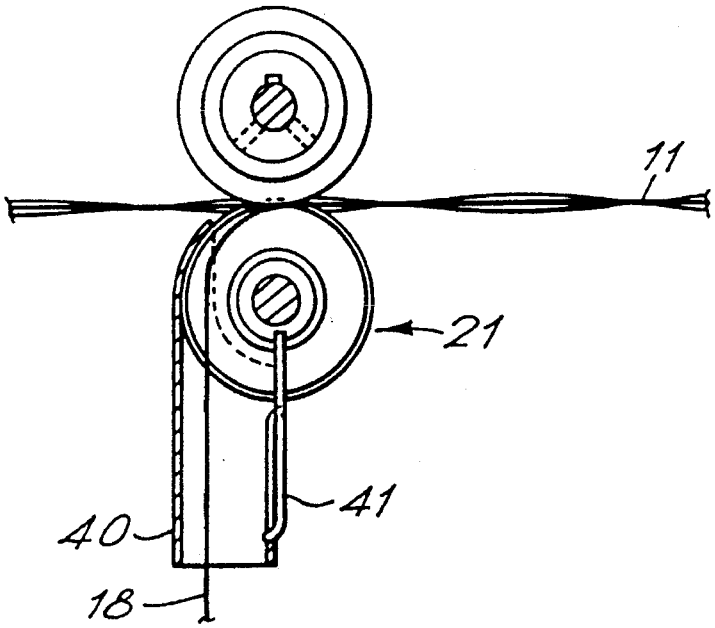
FIG. 5 is a view along arrows V—V in FIG. 4.

As can be seen from FIG. 4, as the travelling web 11 passes between the respective cutting wheels, the strips 18 are sheared from between the pockets 7 and from the edge of the web 11. The strips 18 which are now waste are removed by waste removal means 22 which comprise respective ducts 40 open at one end adjacent a respective set of cutting wheels and connected at its other end to a vacuum source, not shown. Respective fixed fingers 41 which extend along the radius of the respective cutting wheels 35,36 on the shaft 24 positively guide the strips 18 into the respective ducts 40.

The width of strip 18 cut away is chosen to give the desired overlap of the cover leaves in the finished package as will be described later.

From the cutting means 17 the respective strips 19 of infusion packages 1 pass vertically to transverse cutting device 50 for cutting the strips 19 transversely to form individual packages 1. The transverse cutting device 50 comprises a pair of co-rotating rolls 51,52 extending across the whole width of the slotted web 11. Each roll 51,52 comprises a transverse cutting blade 53 let into, and upstanding from, its surface and an anvil 54. The cutting blades 53 co-operate with the anvils 54 to cut the strips 19 transversely. Roll 52 is mounted on a carriage 55 which is movable towards and away from the roll 51 by a mechanism 56, shown schematically, so as to obtain the correct cutting pressure. It will be clear that in each revolution of the rolls 51,52 two transverse cuts will be made. The speed of rotation of tile rolls 51,52 varies cyclically during each revolution, as will be explained in further detail below.

After being cut from the travelling web 11, the packages 1 are attached to a web 70 of cover material, such as styrene, at welding means 100. The web 70 is fed to the welding means 100 at a constant speed. The web 70 first passes over a freely rotating pressure roller 71, pivotally mounted about an axis 72 and biased against the anvil roller 90 by spring means 73 and which maintains the web 70 in good contact with the anvil roller 90. The pressure roller 71 is provided with a rubber coating 74.

As it is conducted around the anvil roller 90, hinge lines 5 are introduced to the web 70 as by hinging means 80. The hinging means 80 comprises a rotary member 81 having a shaft 82 with a pair of notched perforating blades 83 mounted in and upstanding from the surface of the member 81. A cartridge heater 84 extends along the axis of the member 81 and heats the blades 83 which perforate the web both by the pressure exerted against the anvil roller 90, and also by melting the web material 70 locally. The member 81 is mounted on a carriage 85 which is adjustably movable towards and away from the anvil roller 90 by means shown schematically at 86. Thus, after it has passed between the rotary member 81 and the anvil roller 90, the web 70 will be formed, across its width, with rows of perforations which in the finished packages will form the hinge lines 5 about which the two leaves 3,4 of the cover 2 are joined.

From the hinging means 80, the web 70 passes around the anvil roller 90 to the welding means 100. The welding means 100 comprises a rotary shaft 101 on which are mounted diametrically opposed pairs of welding tips 102, clamped between respective plates 103 and which cooperate with the anvil roller 90 to produce a weld. A cartridge heater extends along the axis of the shaft 101 and heats the tips 102. The rotation of the shaft 101 of the welding means 100 is synchronised with that of the rotating hinging member 81 such that the weld in the web 70 is formed in a desired position with respect to the hinge line 5 in the web. Furthermore the shaft 101 is mounted in a carriage 105 which is movable towards and away from the anvil roller 90 by means 106, so as to be able to vary the contact pressure with the anvil roller 90.

Packages 1 cut from the strips 19 of infusion containing pockets 7 by the transverse cutting device 50 are fed vertically by accelerating means 60 to the nip between the welding tips 102 and the anvil roller 90. As stated earlier, the packages 1 should be travelling at the same speed as the web at the welding means 100 to ensure a satisfactory weld between the package 1 and the web 70. Since the speed of the packages 1 through the transverse cutting means 50 is approximately half that of the web 70, the packages 1 must be accelerated by a factor of approximately 2. The acceleration means 60 comprises a driven shaft 61 on which are mounted friction drive tires 62. The tires 62 span the gaps 20 formed between the adjacent strips 19 of packages 1 to grip on the sealed peripheries 8 of the packages. Freely rotating pressure wheels 63 co-operate with the tires 62 on the opposite side of the strips 19. The wheels 63 are mounted in a carriage 64, loaded by spring means 65 to maintain good contact with the strips 19 and thus ensure a positive drive by the tires 62.

The ends of a row of packages 1 are fed into the nip between the respective tires 62 and wheels 63 just before the packages are cut by the transverse cutting device 50. At this time the tires 62 are rotating with a surface speed equal to that of the speed of supply of the strips 19 of packages. However, once the packages 1 have been cut from the strips 19, the tires 62 are accelerated, so as to accelerate the packages 1 to the speed of the web 70. In fact, for stability reasons, the packages are first accelerated slightly above the web speed and then decelerated to the web speed for passage through the welding means 100. The packages 1 are still held by the tires 62 and wheels 63 as they fall into the nip between the anvil roller 90 and the welding tips 102 where they are welded together to accurately control their position in the web 70. It will be appreciated that by accelerating the packages 1, the accelerating means 60 also introduces the necessary longitudinal spacing between the packages. It will also be clear that the rotation of the shaft 61 of the acceleration means 60 is suitably synchronised with that of the welding means 100 so that the packages 1 are presented to be welded in the correct position, which is just to the rear of the hinge line 5 (see FIG. 8).

Once a transverse row of packages 1 is released by the tires 62 and wheels 63, the tires are again decelerated to the speed of the strips 19 of infusion packages before the next row of packages 1 enters the nip between them. The rotation of the transverse cutting rollers 51,52 is synchronised with that of the accelerating means 60 whereby the speed of the rollers is increased between cuts. This allows larger diameter rollers 51,52 to be used which improves the rigidity of the system.

Figure 8:
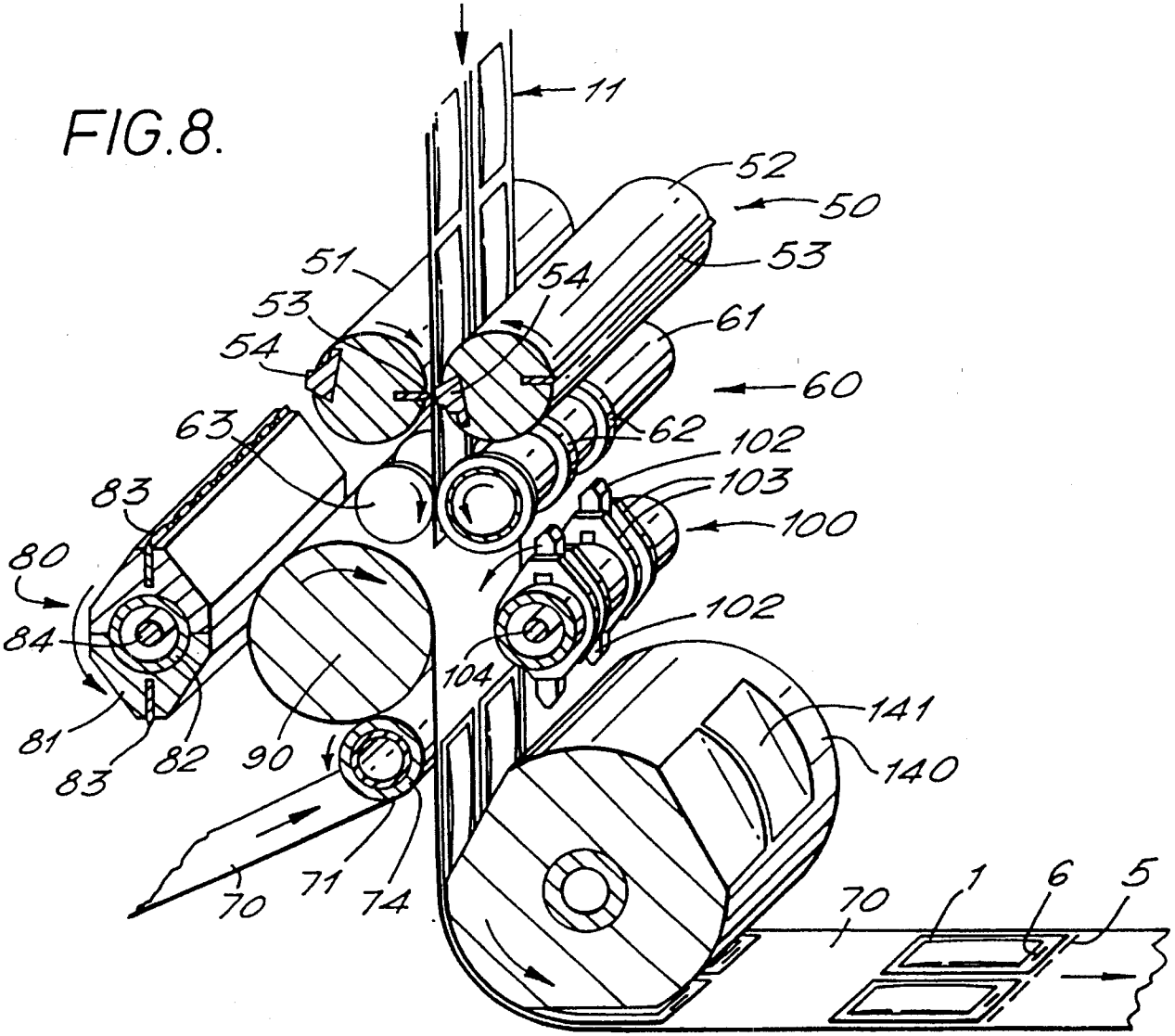
FIG. 8 is a perspective view of the components of FIG. 7.

As will be seen from FIG. 8, the web 70 leaves the welding means 100 having rows of packages 1 welded to it at the desired transverse and longitudinal spacings. The web 70 is turned through 90°, to run horizontally, around a roller 140 which has a plurality of equiangularly spaced peripheral pockets 141 for accommodating the packages 1.

To form individual, covered, packages the web is then cut both longitudinally and transversely. The web 70 is fed by conveyer 114 to longitudinal cutting means 110 comprising co-rotating cutting wheels 112,113, which slit the web 70 between the packages, and remove any excess side trim, which is removed by a vacuum duct 115. Preferably the slit is formed by crush cutting, with a peripheral cutting edge on wheel 112 co-operating under pressure with a surface on an anvil roller 113.

The strips of web so formed are then conveyed to the transverse cutting means 120. The cutting means 120 may comprise an anvil roller 122 and a rotating cutter roller 121 having a cutting blade extending along its surface for cutting the webs into individual lengths.

The individual packages are then conveyed by conveyer 123 to a folding station means 130 which comprises a cam 131 which lifts to guide the front edge of the front leaf 3 of the cover into a curved guide 132 and then retracts. As the package 1 passes under the guide 132, the leaf 3 of the cover is folded back over the package about the hinge line 5. A sponge covered roller 134 consolidates the fold. The individual, covered, packages may then be packaged in any convenient manner.

It is of course possible that the edges of the cover 2 may be sealed to each other prior to packaging if a sealed package is required.

Figure 9:
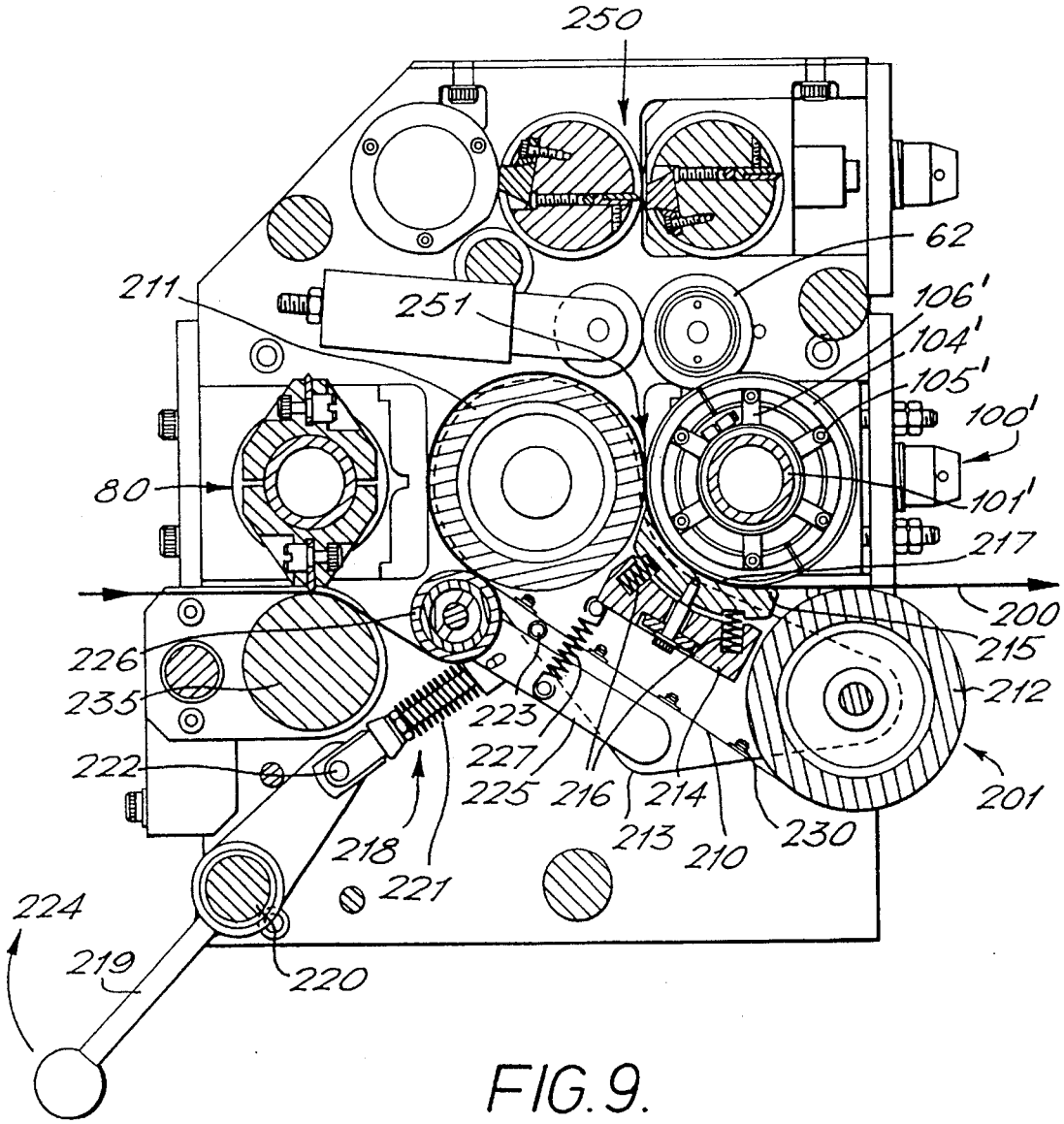
FIG. 9 is a vertical sectional view of a second embodiment of the invention.
Figure 10:
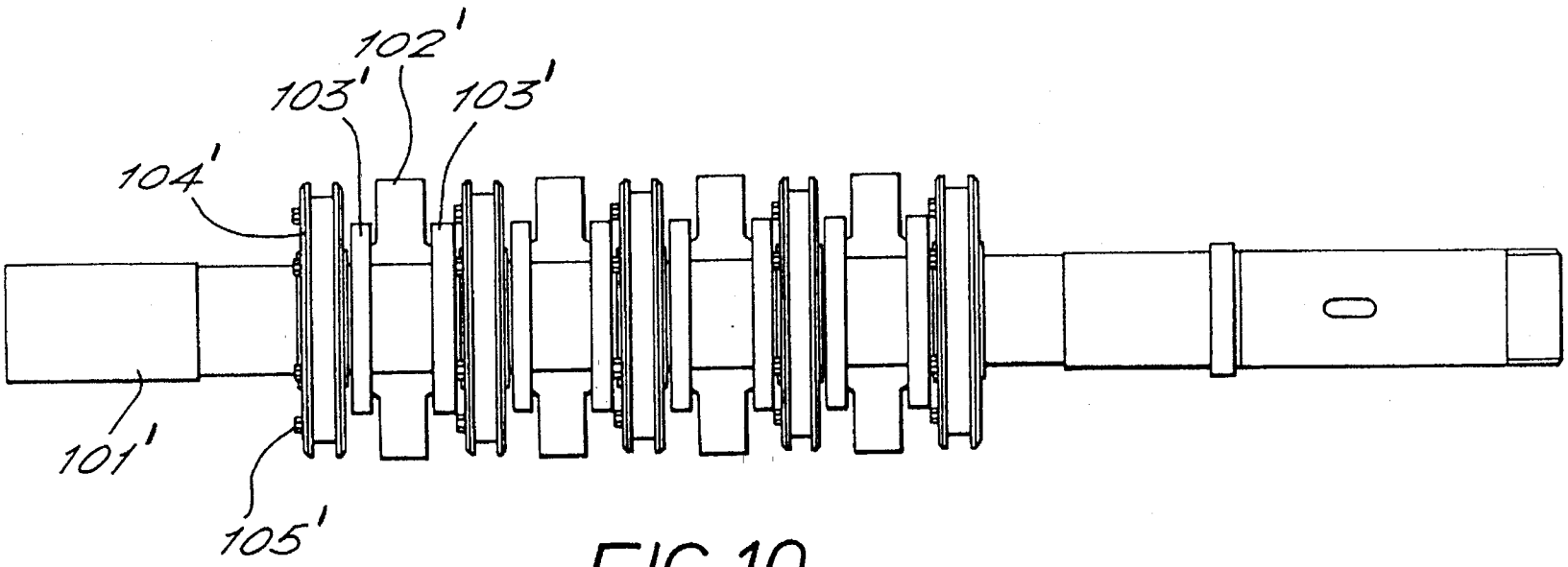
FIG. 10 is a plan view of part of the apparatus of FIG. 9.

Turning to FIGS. 9 and 10, a second embodiment of the invention is illustrated.

The system for feeding infusion packages to the attachment means is essentially as in the earlier embodiment, and common parts are indicated by common reference numerals. Operation of this part of the apparatus will not be described again. The second embodiment differs in the way the infusion packages are attached to the cover web. The path of only the cover web 200 through the apparatus is shown in FIG. 9.

In this embodiment, the place of the anvil roller 90 of the first embodiment is taken by a moving belt assembly 201. The welding means 100' is generally of the same construction as in the first embodiment having diametrically opposed welding tips 102' clamped on a heated rotary shaft 101' between plates 103' (see FIG. 10). However, in addition, the shaft 101' also carries a plurality of U-section wheels 104' arranged between the respective welding tips, as shown. These wheels 104' are mounted via bolts 105' on the ends of respective spokes 106'. The function of the wheels 104' will be described later.

The moving belt assembly comprises a belt 210 which is of a woven glass fabric material coated on both surfaces with p.t.f.e. The belt 210 extends around a drive roller 211 and an idler roller 212 mounted on a carriage 213 which is pivotally mounted in the region of the axis of the drive roller 211. Also mounted to the plate is a support block 214 on which an arcuate backing member 215 is resiliently mounted by springs 216. The backing member 215 is of a high chrome steel material and its upper surface 217 is highly polished, to reduce friction with the belt 210, which is guided over the surface 217 as shown.

The carriage 213, and thus the belt 210 is biased towards the welding means 100 by an over-centre spring mechanism 218. This comprises a handle 219 pivotally mounted about axis 220 and a compression spring assembly 221 extending between pivotal mountings 222 and 223 on the handle 219 and carriage 213 respectively. The over-centre arrangement will allow the carriage 213 and thus the belt assembly to swing away from the welding head 100 when the handle is moved over-centre in the direction of arrow 224, to allow blockages in this region to be cleared. .

A swing arm 225 is mounted on the carriage 213 and mounts, at its free end, a pressure roller 226. The roller 226 is biased against the drive roller 211 by tension spring 227. The belt 210 passes between the roller 226 and the drive roller 211 and is pressed onto the drive roller 211 by the roller 226. The lateral position of the belt 210 on the drive roller 211 is maintained by press studs 230 provided on the lateral edges of the belt 210. These engage with respective shoulders (not shown) provided on the drive roller 211.

In the first embodiment described above, a perforated hinge is formed in the cover web by hinging means 80, comprising perforating blades 83 which cooperated with the anvil roller 90. Since anvil roller 90 has been replaced in this embodiment, a hinging anvil roller 235 is now provided against which the blades 83 press. As in the earlier embodiment the rotation of the blades is synchronised with that of the welding head so that the hinge is produced in the correct position on the web 200.

Operation of this embodiment will now be described.

A web of cover material 200 is threaded between the hinging means 80 and hinging roller 225, around the pressure roller 226 and then, on top of the belt 210, around the drive roller 211 and the welding head 100 to exit generally horizontally. The infusion packages are fed in the same manner as in the earlier embodiment in the direction of arrow 250.

In operation, the belt 210 is driven frictionally by the drive roller 211, against which it is biased by the pressure roller 226. The speed of travel of the belt 210 is such that it matches the peripheral speed of the welding tips 102, such that in their region of cooperation, there is no relative movement between the belt 210 and the tip 102.

The web 200 and the infusion packages to be attached to it are fed together into the nip 251 between the welding tip 102' and the belt 210. The tip 102', web 200 and belt 210 then move through approximately a 90° arc together, in fixed relative positions, the web and package being securely joined together under the joint actions of heat from the tip 102' and the pressure exerted between the tip 102' and the belt 210 due to the resilient backing member 215.

To prevent the packages lifting from the cover web 200 and wrapping around the welding head 100', wheels 104 as described above, engage with the lateral edges of the packages and press them into contact with the belt 210. The lateral position of the wheels 104' is chosen so as not to interfere with the accelerator wheels 62 which also engage the lateral edges of the packages. In fact the respective wheels will engage with laterally spaced regions of the edges of each package.

Once the web leaves the apparatus shown in FIG. 9, it will be cut and folded over the infusion packages as in the earlier embodiment.

I claim:

1. A method of manufacturing infusion packages provided with a cover comprising a pair of leaves joined about a fold line and extending over opposed sides of the package, comprising the steps of forming pockets containing infusion material in a continuously travelling two-ply porous web; passing said porous web through a cutting device which forms a transverse cut through sealed regions of the porous web between the pockets to form a plurality of individual infusion packages; feeding continuously a web of cover material to a rotary attachment means which is synchronized with the cutting device and arranged to attach the packages to the web of cover material at a region adjacent a transverse edge of each package; feeding said packages from the cutting device to said attachment means, each package being accelerated as it leaves the cutting device to introduce a gap between it and a next package and to match a higher feed speed of the web of cover material such that at the time the packages are attached to said web of cover material the package and the web of covering material are travelling at substantially the same speed; and cutting said web of cover material to produce individual lengths of cover material, each having an infusion package arranged towards one end thereof whereby a second end of the cover material may be folded over to enclose the package therebetween.

2. Apparatus for manufacturing infusion packages provided with a cover comprising a pair of leaves joined about a fold line, comprising a cutting device for forming a transverse cut through sealed regions between infusion containing pockets in a travelling two-ply porous web to form a plurality of individual packages; rotary attachment means synchronized with said cutting device for attaching said packages to a web of cover material at a region adjacent a transverse edge of each package; means for continuously supplying said web of cover material to said attachment means; means for supplying said packages to said attachment means; means for accelerating each infusion package as the package leaves said cutting device so that a gap is formed between the package and a next package to be attached to the web of cover material and so that at the time the packages are attached to said web of cover material the packages and the web of cover material are travelling at substantially the same speed; and means for cutting said web of cover material to produce individual lengths of cover material each having an infusion package arranged towards an end thereof whereby a second end of the cover material may be folded over to enclose the package therebetween.

3. A method of manufacturing infusion packages provided with a cover comprising a pair of leaves joined about a fold line and extending over opposed sides of the package, comprising the steps of forming pockets containing infusion material in a continuously travelling two-ply porous web; passing said porous web through a rotary cutting device having a first speed which forms a transverse cut through sealed regions of the porous web between the pockets to form a plurality of individual infusion packages; feeding continuously a web of cover material to a rotary attachment means having a second speed which is synchronized with the cutting device and arranged to attach the packages to the web of cover material at a region adjacent a transverse edge of each package; feeding said packages from the rotary cutting device to said attachment means such that at the time the packages are attached to said web of cover material the packages and the web of cover material are travelling at substantially the same speed as that of said attachment means, each package being accelerated either before or immediately after the package is attached to the web of cover material so that a gap is formed between the package and a next package to be attached to the web of cover material; and cutting said web of cover material to produce individual lengths of cover material, each having an infusion package arranged towards one end thereof whereby a second end of the cover material may be folded over to enclose the package therebetween.

4. A method as claimed in claim 3, wherein said packages are heat sealed or welded to said web of cover material.

5. A method as claimed in claim 3, wherein said packages are accelerated to introduce a gap therebetween and to match a higher feed speed of the web of cover material prior to feeding the packages to the attachment means.

6. A method as claimed in claim 5, wherein said acceleration occurs immediately after the packages have been cut from the two-ply web.

7. A method as claimed in claim 5, wherein said packages are accelerated by co-rotating rollers which grip the package by its longitudinal sealed edges and feed it to the attachment means at a required speed.

8. A method as claimed in claim 5, wherein each package is initially accelerated to a speed above that of the web of cover material and then decelerated to match the speeds of the package and of the web of cover material.

9. A method as claimed in claim 3, wherein said packages are fed substantially vertically to said rotary attachment means.

10. A method as claimed in claim 3, wherein said cover is folded on said package to enclose said package.

11. A method as claimed in claim 3, wherein respective hinge lines for the covers are formed in the web of cover material before the package is attached to the web of cover material.

12. A method as claimed in claim 3, wherein said travelling two-ply web of infusion containing pockets is of several pockets' width, and is divided both longitudinally and transversely to the direction of motion to produce individual packages.

13. A method as claimed in claim 12 wherein the infusion pocket web is split longitudinally by means which removes a longitudinal strip of web material from the sealed region between the or each adjacent longitudinal row of infusion containing pockets to produce parallel travelling strips of sealed pockets which are spaced part from each other in a direction transverse to the direction of movement.

14. A method as claimed in claim 13 wherein the web of cover material extends across a plurality of the strips and the packages attached to the web of cover material in parallel rows across the web which is then cut both transversely and longitudinally to produce individual covered packages with each cover overlapping the edges of the packages in the transverse direction.

15. Apparatus for manufacturing infusion packages provided with a cover comprising a pair of leaves joined about a fold line, comprising a rotary cutting device having a first speed for forming a transverse cut through sealed regions between infusion containing pockets in a travelling two-ply porous web to form a plurality of individual packages; rotary attachment means having a second speed synchronized with said cutting device for attaching said packages to a web of cover material at a region adjacent a transverse edge of each package; means for continuously supplying said web of cover material to said attachment means; means for supplying said packages to said attachment means, such that at the time the packages are attached to said web of cover material the packages and the web of cover material are travelling at substantially the same speed; means for accelerating each infusion package either before or immediately after it is attached to the web of cover material so that a gap is formed between it and the next package to be attached to the web of cover material; and means for cutting said web of cover material to produce individual lengths of cover material each having an infusion package arranged towards an end thereof whereby a second end of the cover material may be folded over to enclose the package therebetween.

16. Apparatus as claimed in claim 15, wherein said rotary attachment means comprises means for heat sealing the packages to the web of cover material.

17. Apparatus as claimed in claim 16, wherein said attachment means comprises a rotary heated member having at least one heat sealing head, and an anvil roller co-operating with said at least one head under pressure.

18. Apparatus as claimed in claim 16, wherein said attachment means comprises a rotary heated member having at least one heat sealing head and a belt extending around an arc of movement of said at least one head and co-operating with said at least one head under pressure.

19. Apparatus as claimed in claim 15, wherein said package acceleration means is arranged upstream of said rotary attachment means.

20. Apparatus as claimed in claim 19, wherein said acceleration means comprises co-rotating rollers which grip the sealed edges of the respective packages.

21. Apparatus as claimed in claim 19, wherein said acceleration means feeds packages generally vertically into said attachment means.

22. Apparatus as claimed in claim 15, comprising means for folding said cover on said package.

23. Apparatus as claimed in claim 15, comprising means for producing a hinge line for a cover in said cover web arranged upstream of said attachment means.

24. Apparatus as claimed in claim 23 wherein said hinge producing means comprises a rotary perforating blade.

25. Apparatus as claimed in claim 15, comprising means for dividing a travelling two-ply web of infusion containing pockets of several pockets' width into a plurality of individual strips of infusion containing pockets.

26. Apparatus as claimed in claim 25 wherein said dividing means comprises cutting means for removing a longitudinal strip of web material from the sealed region between the or each adjacent longitudinal row of infusion containing pockets to produce parallel travelling strips of sealed pockets which are spaced part from each other in a direction transverse to the direction of movement.

27. Apparatus as claimed in claim 25, wherein means are provided for supplying a web of cover material of several packages' width and attaching packages to said web in parallel rows across the web and means for cutting said web longitudinally and transversely to produce individual covered packages with each cover overlapping the edges of the packages in the transverse direction.

28. An infusion package manufactured by apparatus as claimed in claim 15.

* * * * *